US006050501A

United States Patent [19]

O'Rourke

[11] Patent Number: 6,050,501

[45] Date of Patent: Apr. 18, 2000

[54] RECREATIONAL WATER SPRINKLER

[75] Inventor: James P. O'Rourke, Brentwood, Tenn.

[73] Assignee: Kidpower, Inc., Brentwood, Tenn.

[21] Appl. No.: 09/134,707

[22] Filed: Aug. 14, 1998

[51] Int. Cl.[7] ..... B05B 3/00

[52] U.S. Cl. ..... 239/229; 239/225.1

[58] Field of Search ..... 239/229, 225.1, 239/263, 227, 231, 232, 243

[56] References Cited

U.S. PATENT DOCUMENTS

| | | | |
|---|---|---|---|
| 374,960 | 12/1887 | Gumaer et al. | 239/229 |
| 2,757,960 | 8/1956 | Hatcher | 239/229 |
| 4,235,378 | 11/1980 | Melin et al. | 239/229 |

FOREIGN PATENT DOCUMENTS

| | | | |
|---|---|---|---|
| 753004 | 12/1954 | United Kingdom | 239/229 |

OTHER PUBLICATIONS

Little Tikes Waterpark Whirlee—1996.

*Primary Examiner*—David J. Walczak
*Attorney, Agent, or Firm*—Lucian Wayne Beavers Waddey & Patterson

[57] ABSTRACT

A Recreational Water Sprinkler apparatus includes a manifold having a water inlet and a plurality of manifold outlets. A plurality of elongated flexible discharge hoses are connected to the manifold outlets. The hoses are sufficiently long and flexible that when water is supplied at conventional household pressures, the water is discharged through the discharge hoses thereby causing the hoses to gyrate and whip back and forth in a random manner relative to the manifold, thus spraying water randomly in all directions within a hemispherical space around and above the manifold.

12 Claims, 5 Drawing Sheets

RECREATIONAL WATER SPRINKLER

Be it known that I, James P. O'Rourke, a citizen of United States, residing at 2947 Hillsboro Road, Brentwood, Tenn. 37027; have invented a new and useful "Recreational Water Sprinkler."

BACKGROUND OF THE INVENTION

The present invention relates generally to recreational water sprinklers.

It is commonly known that children enjoy a myriad of activities associated with water play that include the use of flotation devices, water toys, water pistols and guns, sprinklers and the like. Water sprinklers provide a convenient means for children to enjoy water play when they do not have ready access to a swimming pool. Although conventional water sprinklers may be used, children more often enjoy sprinkling devices that incorporate features other than a mere oscillating spray. Accordingly, many designs for recreational sprinklers incorporate ornamental features, such as spraying fire plugs or flowers, that make the device more appealing to children.

However, all of the water sprinklers described above merely spray water in a constant, predictable fashion from one or more locations on the device. What is needed, then, is a recreational water sprinkler comprising a body with a plurality of flexible spray arms for squirting water in a random, unpredictable fashion.

SUMMARY OF THE INVENTION

A recreational water sprinkler is provided which includes a body, and a manifold connected to the body. The manifold is configured for operable attachment to a water supply. The manifold has at least one manifold outlet. At least one flexible arm member or discharge hose extends from the body. The flexible arm member has a conduit defined therein which is in fluid communication with the manifold outlet so that water which enters the manifold may be expelled from the conduit.

Preferably, there are a plurality of such flexible arm members. Each of the flexible arm members is sufficiently long and flexible that when a water supply at conventional household pressure is provided to the apparatus, the water is discharged through the flexible arm members thereby causing the flexible arm members to gyrate and whip back and forth in a random manner relative to the manifold, thus spraying water randomly in all directions within a hemispherical space around and above the manifold.

Methods of using such an apparatus are also disclosed.

It is, therefore, a general object of the present invention to provide a recreational water sprinkler apparatus.

Another object of the present invention is the provision of a water sprinkler apparatus having a plurality of elongated flexible discharge hoses which are arranged so they may gyrate and whip back and forth in a random manner thus spraying water randomly in all directions within a hemispherical space.

Another object of the present invention is the provision of methods of using such apparatus.

Numerous other objects, features and advantages of the present invention will be readily apparent to those skilled in the art, upon a reading of the following disclosure when taken in conjunction with the accompanying drawings.

BRIEF DESCRIPTION OF THE DRAWINGS

In FIG. 6, the dome-shaped housing cover has been removed.

DETAILED DESCRIPTION OF THE PREFERRED EMBODIMENTS

Figure 1:
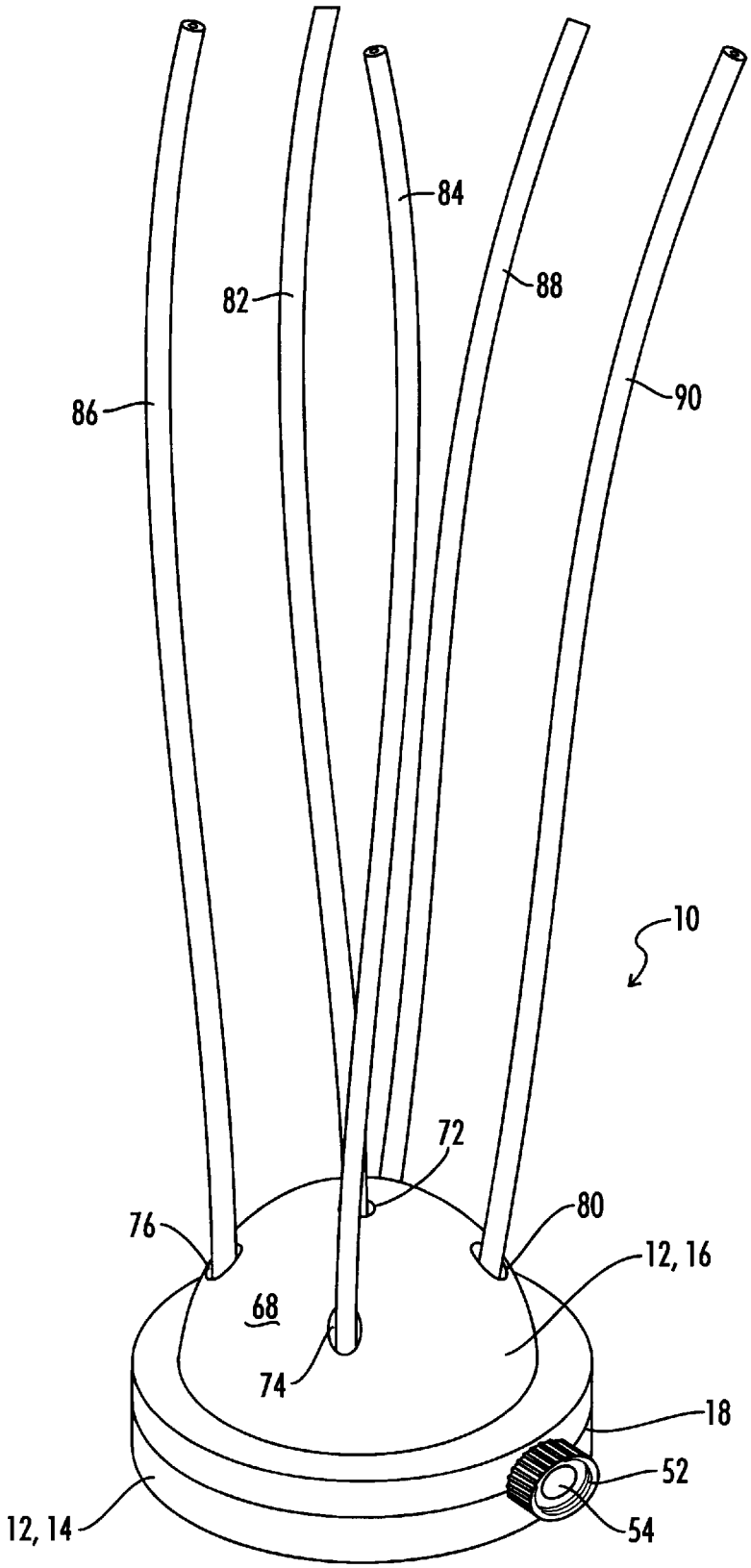
FIG. 1 is a perspective view of the apparatus of the present invention.

Referring now to the drawings, and particularly to FIG. 1, a Recreational Water Sprinkler apparatus is there shown and generally designated by the numeral 10.

Figure 5:
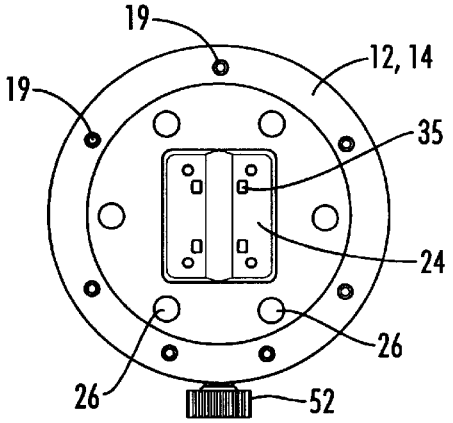
FIG. 5 is a bottom view of the housing.
Figure 2:
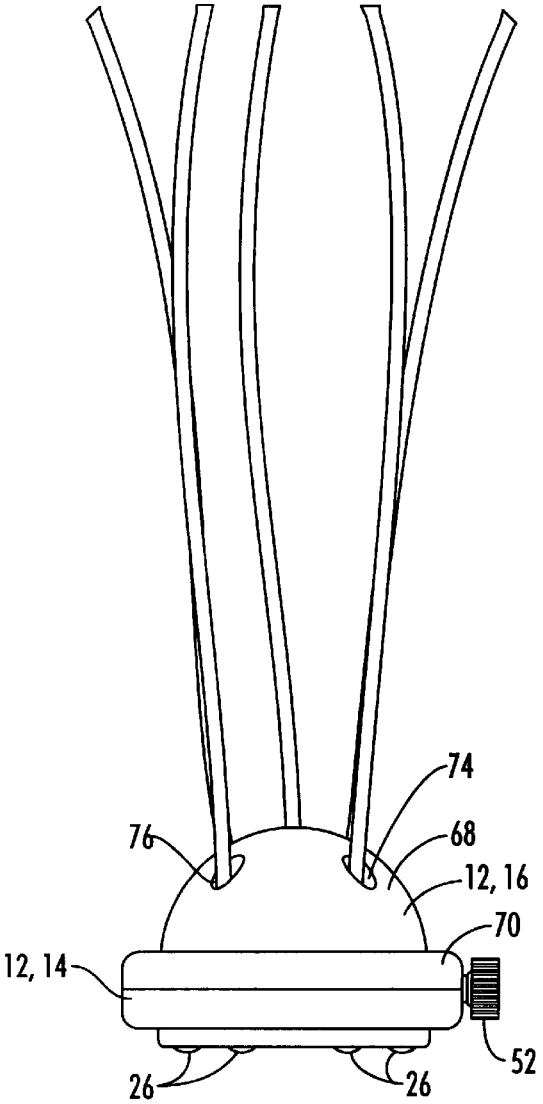
FIG. 2 is an elevation view of the apparatus of FIG. 1
Figure 3:
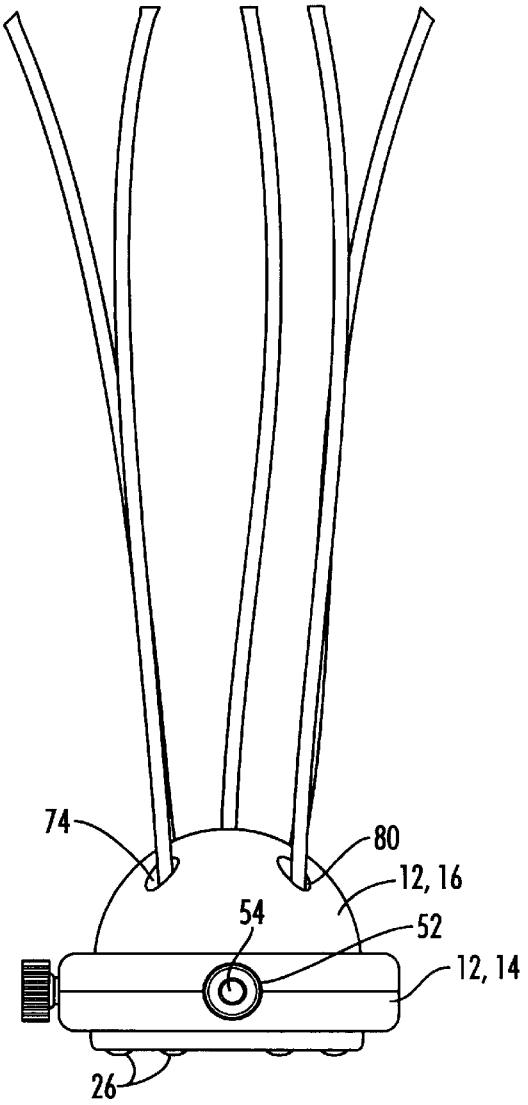
FIG. 3 is another elevation view taken along the right hand side of FIG. 2.

The apparatus 10 includes a housing or body designated by the numeral 12. The housing 12 includes a base 14 and a substantially dome-shaped top or cover 16. As seen in FIG. 1, the base 14 and cover 16 are joined at a line 18. The base 14 and cover 16 are held together by screws or other conventional attachment means, as seen in FIG. 5.

The base 14 and cover 16 are each preferably molded from thin shell rigid plastic materials.

Figure 6:
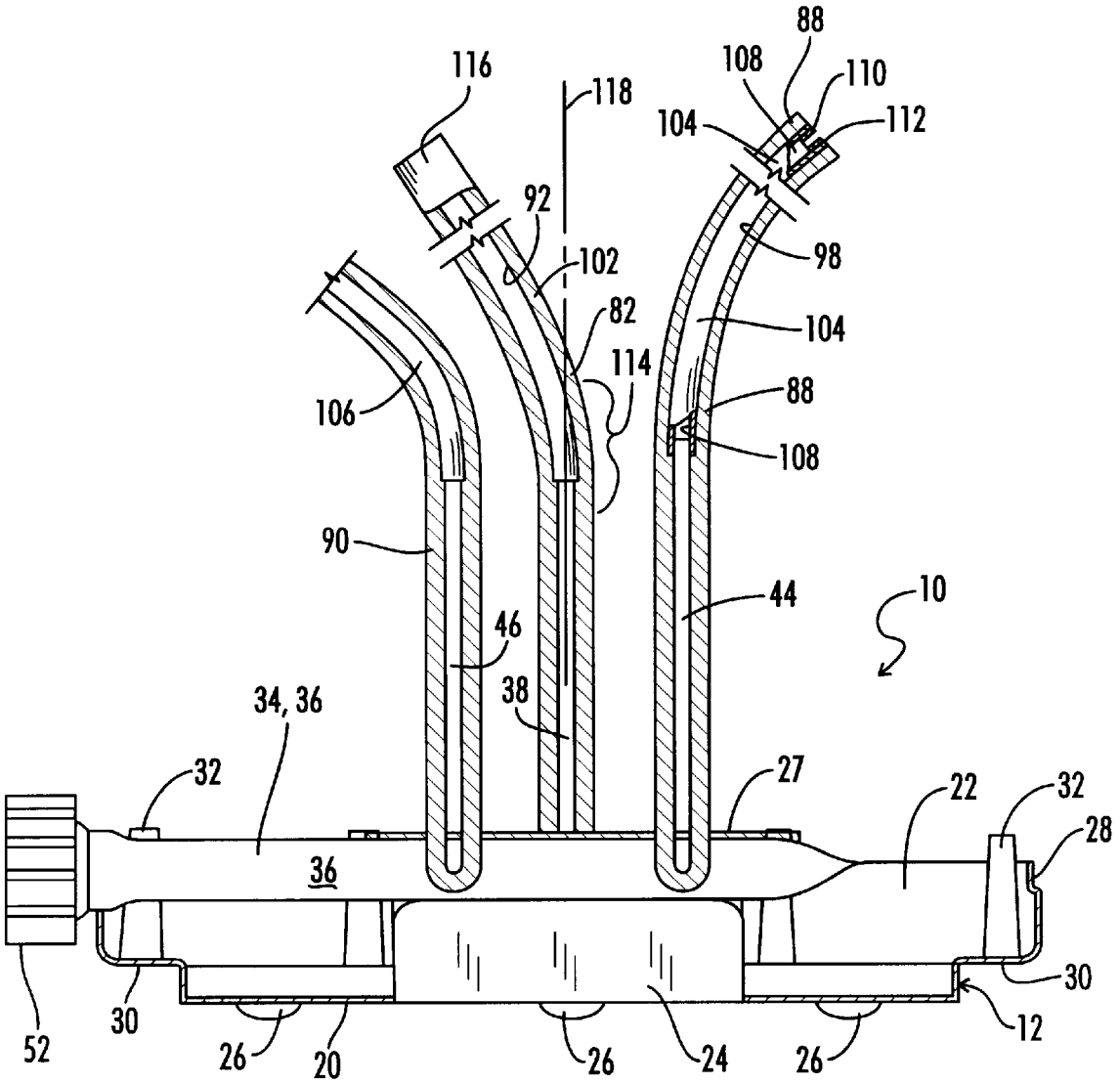
FIG. 6 is a side elevation sectioned view of the apparatus taken along line 6—6 of FIG. 4.

The details of construction of the base 14 are best seen in the cross-sectional view of FIG. 6. The base 14 is a thin shell molded plastic member having a bottom 20, an annular side wall 22 and a generally square raised platform section 24 in the center thereof. A plurality of downward extending dome-shaped protrusions 26 serve as feet to support the base 14 from a ground surface.

The side wall 22 has a step or groove 28 formed in the upper periphery thereof for mating with a complementary shaped lip on the dome-shaped cover 16. The floor 20 steps up to an outer annular ring shaped floor portion 30. A plurality of support posts 32 extend upward from the annular floor portion 30 for mating with corresponding supported structures of the dome-shaped housing 16. The base 14 and housing 16 are connected by conventional screws 19 which are contained within the hollow posts 32 and extend upward therefrom into engagement with threaded receptacles in the dome-shaped cover 16.

Figure 7:
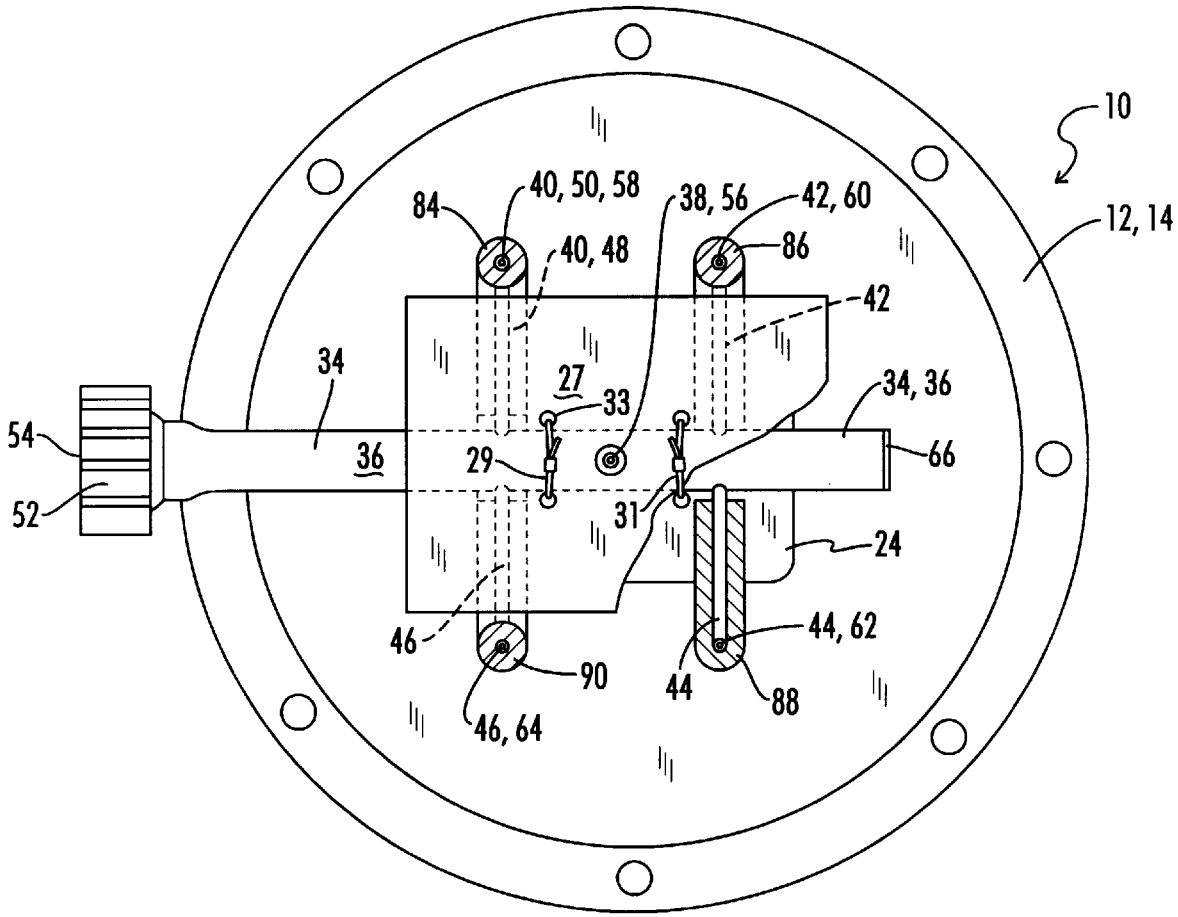
FIG. 7 is a plan view of those portions of the apparatus shown in FIG. 6, again with the dome-shaped cover being removed to show the internal arrangement of the manifold upon the base of the housing.

The apparatus 10 includes a manifold 34 best seen in FIGS. 6 and 7. The manifold 34 includes a central manifold member 36 which may also be referred to as a diverter tube 36. The manifold 34 further includes first, second, third, fourth and fifth manifold branches 38, 40, 42, 44, and 46, respectively. The first manifold branch 38 is simply a vertically extending tube which communicates with the central manifold tube or diverter tube 36. The second, third, fourth, and fifth manifold branches, 40 through 46, each include a horizontal section, such as 48 (see FIG. 7), communicated with the diverter tube 36, and a vertical section, such as 50, which extends upwardly.

The diverter tube 36 has a conventional threaded hose connector 52 on one end thereof for connection of the apparatus 10 to a conventional garden hose. The hose connector 52 defines an open water inlet 54 of the manifold 34.

Figure 9:
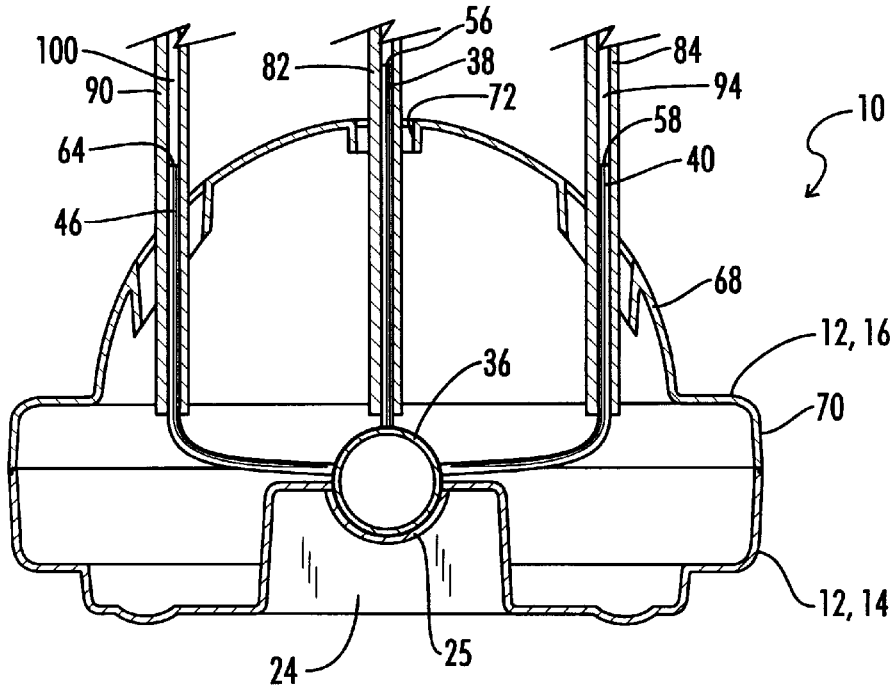
FIG. 9 is another elevation section view of the embodiment of FIG. 8 rotated 90 degrees from FIG. 8.

The generally square raised platform 24 has, as best seen in FIG. 9, a semi-circular cross-section trough 25 defined in the upper portion thereof. The cylindrical manifold diverter tube 36 is received within the trough 25. As seen in FIG. 6 and 7, a mounting plate 27 lies on top of the diverter tube 36 above the horizontal portions of the manifold branches 40 through 46. The mounting plate 27 is strapped to the base 12 by two plastic ties 29 and 31 which extend upward through openings such as 33 in the mounting plate 27 and which extend downwardly through openings 35 (see FIG. 5) in the raised platform section 24. Thus the plastic ties 29 and 31 hold the mounting plate 27 in place relative to base 12 with the manifold 34 sandwiched therebetween so as to hold the manifold 34 in place within the trough 25 of raised platform section 24.

The top ends of each of the manifold branches 38 through 44 are open and define manifold outlets 56, 58, 60, 62, and 64, respectively.

The diverter tube 36 has a closed second end 66. The diverter tube 36 is preferably formed from a plastic tube, and the closed end 66 may be formed by flattening and welding shut the end of the diverter tube 36.

Figure 8:
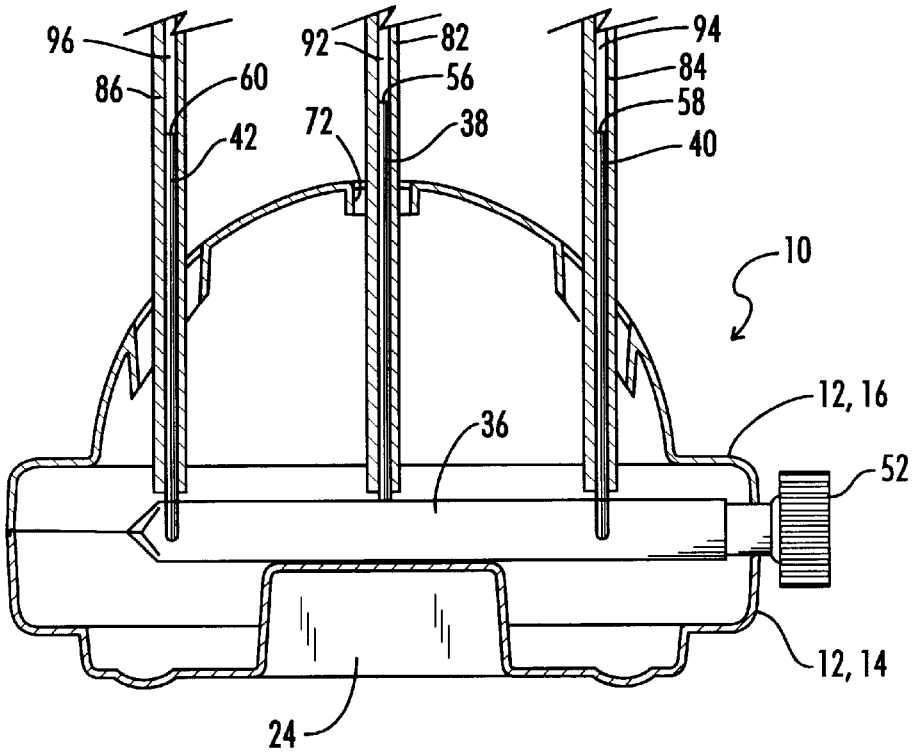
FIG. 8 is an elevation section somewhat schematic view of an alternative embodiment of the invention.

The dome-shaped cover 16 includes a central hemispherical dome portion 68 surrounded by an annular flange portion 70. The flange portion 70 mates with the complementary groove 28 in base 14 as best shown in FIGS. 8 and 9. The dome portion 68 of cover 16 includes first, second, third, fourth, and fifth openings 72, 74, 76, 78, and 80 defined therethrough.

Figure 4:
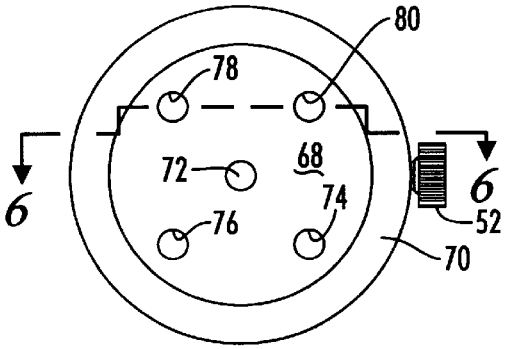
FIG. 4 is a plan view of the apparatus with the discharge hoses being eliminated to show the top surface of the housing of the apparatus.

As best seen in FIG. 4, the plurality of openings 72 through 78 may be described as being arranged in the pattern of a five-spot face of a die with one opening at each corner of a square pattern and a fifth opening in the center of the square pattern.

As best seen in FIGS. 8 and 9, the vertical portions of the manifold branches 38, 40, 42, 44, and 46 extend upward through their respective openings and extend above the dome-shaped cover 16. The manifold branches 38 through 46 are preferably formed from a relatively rigid hard plastic tubing.

The apparatus 10 includes first, second, third, fourth, and fifth flexible arm members or discharge hoses 82, 84, 86, 88, and 90.

Each of the discharge hoses is an elongated hollow tube constructed of foam plastic material. Each elongated hollow tube discharge hose has an interior channel 92, 94, 96, 98 or 100, respectively.

In one embodiment as shown in FIGS. 8 and 9, the interior channels 92 through 100 of the flexible discharge hoses 82 through 90 provide a conduit which directly carries water from the manifold branches to the distal ends of the hoses.

In another embodiment such as illustrated in FIG. 6, the discharge hoses further include an impervious water conducting inner tube such as 102, 104, and 106, which inner tubes are fitted over the upper ends of the respective manifold branches 38, 44, and 46. The inner tubes such as 102, 104, and 106 are received within the interior channels such as 92, 98, and 100 of their respective discharge hoses 82, 88, and 90. In the embodiment of FIG. 6, the conduit of the discharge hose which actually carries the water is the inner passage such as 108 of the inner tube 104.

When using the embodiment of FIG. 7 with the inner tubes such as 102, 104, and 106, a nozzle 110 will be attached to the free distal end 112 of inner tube 104.

As previously noted, the manifold branches 38 through 46 are made of rigid plastic tube and may be described as being substantially more rigid than are the flexible arm members or discharge hoses 82 through 90.

As shown in FIG. 6, the vertically upward extending portions of each of the manifold branches 38 through 46, provide a support which holds a lower end portion, such as 114, of their respective discharge hoses 82 through 90 in an upwardly directed position so that an upper portion, such as 116, of each discharge hose above its respective manifold branch is free to gyrate about a generally vertical upwardly oriented axis, such as 118, of its respective manifold branch.

Thus, when a conventional household water supply is provided to the inlet 54 at conventional household pressures, the water is divided by the manifold 34 into a plurality of streams directed into each of the discharge hoses 82 through 90. As the water exits in jets from the distal end of the discharge hoses, the jet forces acting upon the upper end of the hoses causes the hoses to gyrate in a random manner whereby they whip back and forth and rotate about the vertical axis of their respective manifold branch thus spraying water out of the hoses in random directions around and above the apparatus 10 and the manifold 34 thereof. In general, this can be described as spraying water randomly in all directions within a hemispherical space around and above the apparatus 10 and the manifold 34 thereof.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A recreational water sprinkler, comprising:

a body, including:

a base; and a substantially dome-shaped top having a plurality of openings defined therein, the top being mounted upon the base;

a manifold separable from the body and connected to the body and configured for operable attachment to a water supply; the manifold having at least one manifold outlet, the manifold including a diverter tube attached to the base and contained under the dome-shaped top;

a plurality of manifold branch tubes extending from the diverter tube through the openings in the dome-shaped top, each of the branch tubes being connected to one of the flexible arm member; and at least one flexible arm member extending from the body, the at least one flexible arm member having a conduit defined therein that is in fluid communication with the at least one manifold outlet whereby water that enters the manifold may be expelled from the conduit.

2. The water sprinkler of claim 1 wherein the at least one arm member further comprises:

a plurality of arm members.

3. The water sprinkler of claim 1, wherein the manifold branch tubes are substantially more rigid than are the flexible arm members.

4. The water sprinkler of claim 1, wherein the conduit defined in the at least one flexible arm member is an interior channel of the arm member.

5. The water sprinkler of claim 1, wherein:

the at least one flexible arm member has an interior channel defined therethrough; and the water sprinkler further includes a flexible inner tube received in the interior channel of the flexible arm member, the flexible inner tube defining the conduit of the flexible arm member and being connected to the manifold outlet.

6. The water sprinkler of claim 1, further comprising:

a threaded connector for attaching the sprinkler to the water supply.

7. The water sprinkler of claim 1, wherein the at least one arm member is constructed of a foam material.

8. The water sprinkler of claim 1, further comprising:

a nozzle attached at a distal end of the conduit.

9. A recreational water sprinkler apparatus comprising:

a manifold including a water inlet and including a plurality of manifold outlets;

a plurality of elongated flexible discharge hoses, each of the hoses being connected to one of the manifold outlets, the hoses being sufficiently long and flexible that when a water supply at conventional household pressures is provided to the water inlet, the water is discharged through the discharge hoses thereby causing the hoses to gyrate and whip back and forth in a random manner relative to the manifold and thus spraying water randomly in all directions within a hemispherical space around and above the manifold;

wherein each of the hoses includes an elongated hollow foam outer tube, and an impervious water conducting inner tube received in the outer tube;

each of the inner tubes having a first end connected to one of the manifold outlets and having a free second end; and a plurality of nozzles, each one of the nozzles being connected to the free end of one of the inner tubes, and each nozzle having an outlet orifice diameter less than an inside diameter of the inner tubes.

10. The apparatus of claim 9, wherein:

the manifold includes a plurality of upwardly extending relatively rigid manifold branches, each of the manifold outlets being defined at an upper end of one of the manifold branches; and each one of the elongated flexible discharge hoses is attached to one of the manifold branches so that a lower portion of each of the hoses is held in upwardly directed orientation so that an upper portion of each hose above its respective manifold branch is free to gyrate about an upwardly directed axis defined by the manifold branch.

11. The apparatus of claim 10, further comprising:

a housing including a base and a cover attached to the base, the cover having a plurality of openings defined therethrough; and the manifold being supported from the base, with each one of the manifold branches extending upward through one of the openings of the cover.

12. The apparatus of claim 11, wherein:

the cover includes five of the openings arranged in the pattern of a five-spot face of a die.

* * * * *